US008833677B2

(12) United States Patent
Chang

(10) Patent No.: US 8,833,677 B2
(45) Date of Patent: Sep. 16, 2014

(54) SPORT-TYPE MULTIFUNCTIONAL SPRAY MINERAL WATER BOTTLE

(75) Inventor: Chang Ho Chang, Taoyuan (TW)

(73) Assignee: Shenzhen Nozo Investment Co., Ltd, Shenzhen (CN)

( * ) Notice: Subject to any disclaimer, the term of this patent is extended or adjusted under 35 U.S.C. 154(b) by 991 days.

(21) Appl. No.: 12/912,882

(22) Filed: Oct. 27, 2010

(65) Prior Publication Data

US 2011/0180630 A1 Jul. 28, 2011

Related U.S. Application Data

(63) Continuation-in-part of application No. 12/696,047, filed on Jan. 28, 2010, now abandoned, and a continuation-in-part of application No. 12/757,202, filed on Apr. 9, 2010, now Pat. No. 8,662,419, and a continuation-in-part of application No. 12/912,426, filed on Oct. 26, 2010.

(51) Int. Cl.

| | |
|---|---|
| ***B65B 1/32*** | (2006.01) |
| ***B65D 1/02*** | (2006.01) |
| ***B65D 47/24*** | (2006.01) |
| ***B65D 47/06*** | (2006.01) |

(52) U.S. Cl.

CPC ..... *B65D 47/06* (2013.01); *B65D 2547/063* (2013.01); *B65D 1/0207* (2013.01); *B65D 47/243* (2013.01)

USPC .... 239/327; 239/437; 239/581.1; 222/153.11

(58) Field of Classification Search

CPC ..... B65D 2547/063; B65D 1/0207; B65D 47/243; B65D 47/06; B05B 11/0029; B05B 1/1636; B05B 1/3026; B05B 11/0094

USPC ..... 239/581.1, 437, 327; 222/153.11

See application file for complete search history.

(56) References Cited

U.S. PATENT DOCUMENTS

| | | | | |
|---|---|---|---|---|
| 3,188,008 | A * | 6/1965 | Green | 239/337 |
| 3,206,082 | A * | 9/1965 | Green | 222/402.17 |
| 6,161,777 | A * | 12/2000 | Carter et al. | 239/222.11 |
| 6,354,320 | B1 * | 3/2002 | Kolacz et al. | 137/38 |
| 6,722,585 | B1 * | 4/2004 | Stradella | 239/533.13 |
| 7,490,742 | B2 * | 2/2009 | Yu | 222/183 |
| 8,210,497 | B2 * | 7/2012 | Ko | 251/258 |
| 2008/0006718 | A1 * | 1/2008 | Junkel et al. | 239/333 |

* cited by examiner

*Primary Examiner* — Jason Boeckmann

(74) *Attorney, Agent, or Firm* — Garcia-Zamor IP Law; Ruy M. Garcia-Zamor

(57) ABSTRACT

The invention discloses a sport-type multifunctional spray mineral water bottle, including cap body, spray means, drink means and water locking means. The invention can ensure normal drinking of mineral water as well as carry out spray drinking of water by means of squeezing the bottle body to transform bottle body and increase the pressure inside the bottle, thus making water to enter inlet from the outlet of water locking means on the cap, and to enter the atomizing channel through the water channel, finally to be sprayed from the spray aperture. Furthermore, in the open air or in the dusty and hot environment, you can place the mineral water bottle upside down, put the nozzle to face your body or surrounding, and squeeze the bottle body to spray, thus reducing surrounding temperature, as well as subsiding dust by combining dust and spray to make you feel cool, fresh and comfortable.

9 Claims, 6 Drawing Sheets

SPORT-TYPE MULTIFUNCTIONAL SPRAY MINERAL WATER BOTTLE

CROSS REFERENCE TO RELATED APPLICATIONS

This application is a continuation in part of and claims benefit of and priority to the following patent properties: (1) U.S. patent application Ser. No. 12/696,047, filed on Jan. 28, 2010, (2) U.S. patent application Ser. No. 12/757,202 filed on Apr. 9, 2010, (3) Ser. No. 12/912,426 filed on Oct. 26, 2010 and (4) Chinese Patent Application CN 201010515802.8, filed on Oct. 22, 2010; each of the above listed applications is hereby incorporated by reference herein as if set forth in its entirety.

TECHNICAL FIELD

The invention relates to a sport-type mineral water bottle, especially refers to a sport-type mineral water bottle with merits of spraying and drinking for outdoors.

BACKGROUND ART

The common mineral water bottle includes the cap body which is screwed with the mineral water bottleneck, and the cap body is matched with mineral water bottleneck by means of liquid-tight fit. When you want to drink the mineral water in the bottle, you remove the cap and directly drink the water. This type of cap is used for sealing the mineral water inside the bottle body, and anti-fake function as well. This type of cap has simple functions so that the mineral water bottle matched with the cap has simple functions as well, which cannot satisfy the demands of daily life of people.

Presently the mineral water, which is taken outside the home, is mainly used for drinking. When it is extremely hot or when you watch football in a stadium in the summer heat, you may want to spray the mineral water directly to your face or head to reduce temperature. However, if pouring mineral water, you may waste too much water and it cannot satisfy your demands due to insufficient water. In addition, temperature reduction effect is limited by this type of method and surrounding air cannot be improved if it is dusty. Therefore the conventional cap needs to be modified and perfected.

SUMMARY OF THE INVENTION

Aiming at the shortcomings above in existing technology, the invention is to provide a spraying mineral water bottle for drinking or to adjust the air environment surrounding the human body by spraying.

For achieving the objective above, this invention adopts the following technical solution:

A sport-type multifunctional spray mineral water bottle, including an elastic deformation bottle and a spray mineral water bottle cap, characterized in that the spray mineral water bottle cap including:

A cap body, wherein the cap body and bottleneck are connected by means of liquid-tight fit, and an outlet aperture is disposed on the end face of the cap body;

A drink means, wherein the drink means includes a water outlet in the cap body and a movable rubber plug, wherein the movable rubber plug moves along the outlet up and down to open or close the outlet;

A spray means, wherein the spray means includes an atomizing spool and nozzle, and two water channels are disposed on the outer wall of the atomizing spool, and atomizing channels corresponding to the water channels are disposed on the end face of atomizing spool corresponding to water channels; a cavity is disposed in the nozzle to hold the atomizing spool, and a spray aperture is on the end face of the nozzle; interference fit is fulfilled between the atomizing spool and nozzle cavity, and the atomizing aperture and nozzle are fit and fed through;

A water locking means, wherein the water locking means includes a fixing part and a movable part which rotates relative to the fixing part, and the fixing part is fixed and connected to the cap body and an outlet is disposed; an inlet is disposed on the movable part corresponding to the outlet of fixing part; the movable part rotates relative to the fixing part back and forth to fulfill the butt joint or interleaving between the outlet of fixing part and the inlet of movable part, thus achieving the opening or closing of the spray means; a cavity is disposed in the movable part, and interference fit is fulfilled between the spray means and the cavity.

The foresaid fixing part of water locking means is a tube located axially in the center of cap body, and this tube bottom is closed and an outlet is disposed on the sidewall of the tube adjacent to the bottom; the foresaid movable part bottom of water locking means is connected to the tube by means of liquid-tight sleeve joint and rotates relative to the tube, and an inlet is disposed on the movable part bottom corresponding to the outlet of fixing part; the movable part rotates relative to the fixing part to fulfill the butt joint or interleaving between the outlet and inlet, thus achieving the opening or closing of the spray means.

An annular groove is disposed on the inner wall of the tube of the foresaid fixing part of water locking means, and an annular protuberance is disposed in the foresaid movable part of water locking means matching with the groove on the inner wall of the tube of the fixing part.

A cylindric protuberance is disposed in the interior of end face of the foresaid fixing part bottom of water locking means, and this cylindric protuberance is matched with the inside diameter of movable part bottom of water locking means.

The foresaid movable part of water locking means is straight line shape, matched with and disposed in the fixing part tube, and it rotates relative to the tube; the spray means is disposed in the cavity on the upper end of movable part by means of interference fit.

The foresaid movable part of water locking means is right angle shape, including the connected tubes, one in vertical direction and the other in horizontal direction, and the tube in vertical direction and tube in horizontal direction are molded into one unit; the tube in vertical direction is connected to the fixing part of water locking means by means of liquid-tight fit, the movable part rotates relative to the fixing part pursuant to the tube in vertical direction as axis; a cavity is disposed inside the tube in horizontal direction, and the spray means is disposed in the cavity and connected to the cavity by means of interference and liquid-tight fit.

A rotating handle is disposed in the upper end exterior of the foresaid movable part of water locking means, on-off position means is disposed between the middle and the end face of cap body, and the position means, including position blocks respectively fixed on the 0° and 90° positions of end face of cap body and a limiting stopper fixed on the corresponding position of movable part.

The on-off position means of water locking means is disposed on the foresaid end face of cap body, and this position means includes position blocks respectively fixed on 0° and 90° positions of end face of cap body, respectively positioning opening and closing of water locking means, and cambered surfaces are disposed on the position blocks in the rotating direction of the tube in the vertical direction to match with the tube.

A limiting protuberance is disposed on the cambered surface bottom of the closed position block of the foresaid position water locking means corresponding to the other side of the tube in horizontal direction, to prevent the tube from automatically opening without external force.

The foresaid fixing part of water locking means is fixed on the end face of cap body, spherical working face is disposed on the fixing part, wherein an outlet is disposed; the foresaid movable part of water locking means includes a sphere which is matched with the spherical working face on the fixing part by means of liquid-tight fit, and flexibly connected to the fixing part by means of the rotating axis; a strip inlet is disposed in the outlet rotating track of the sphere, and when the sphere leaves the closing status of water locking means, the butt joint between the outlet and inlet is opened; the tube is fixed on the sphere, the tube cavity is connected to the strip inlet, and open-end of the tube is connected to the spray means by means of interference and liquid-tight fit.

A position means for opening and closing of the movable part is disposed in the foresaid fixing part of water locking means, which allows the movable part to rotate within the specified radian of 90° degrees.

By adopting the above structure, with the coordination of the elastic mineral water boty and the capy, the spray mineral water of the invention can ensure normal drinking of mineral water as well as carry out spray drinking of water by means of squeezing the bottle body to transform bottle body and increase the pressure inside, thus making water to enter inlet from the outlet of water locking means on the cap, and to enter the atomizing channel through the water channel, finally to be sprayed from the spray aperture. Furthermore, in the open air or in the dusty and hot environment, you can place the mineral water bottle upside down, put the nozzle to face your body or surrounding, and squeeze the bottle body to spray, thus reducing surrounding temperature, as well as subsiding dust by combining dust and spray to make you feel cool, fresh and comfortable. This invention features in simple structure and strong practicability, so it has promising market prospect.

DETAILED DESCRIPTION OF THE PREFERRED EMBODIMENT

The present invention will now be described by referring to the accompanying drawings that illustrate the preferred embodiments of the invention, from which its objects and features will be evident.

Embodiment 1

Figure 1:
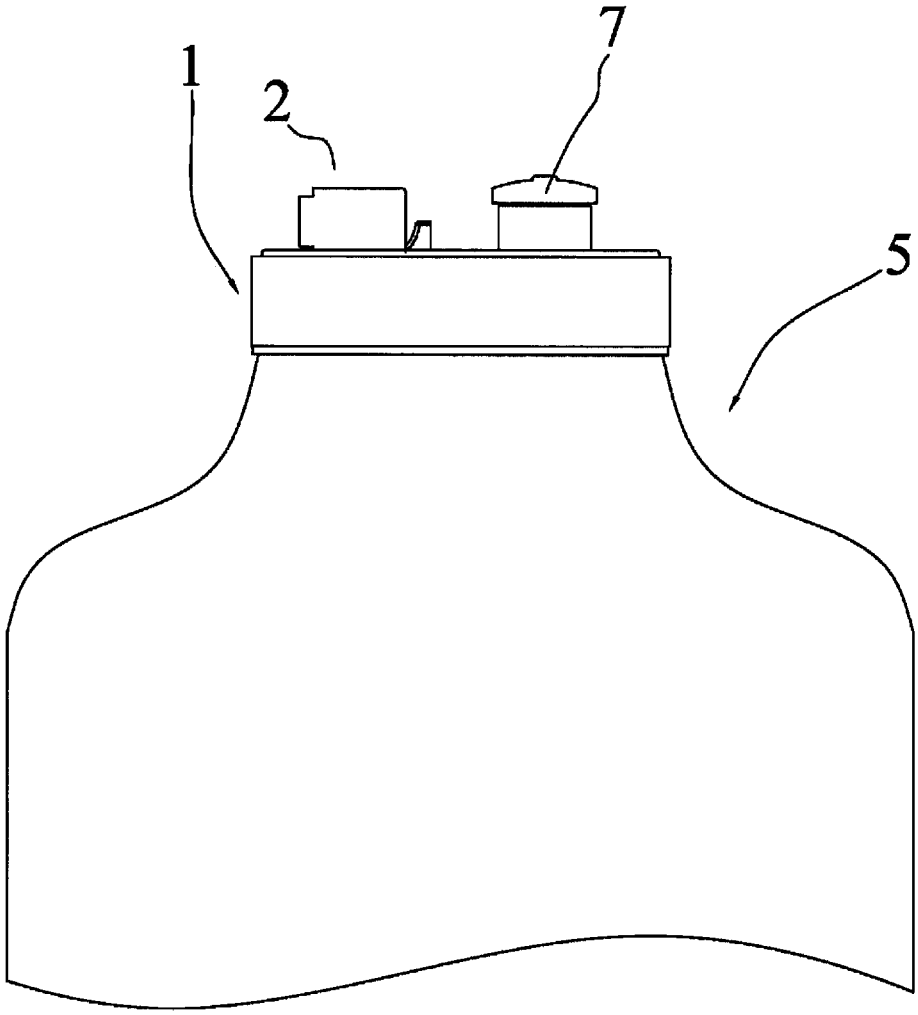
FIG. 1 is the structure drawing of the embodiment 1 of the invention.
Figure 2:
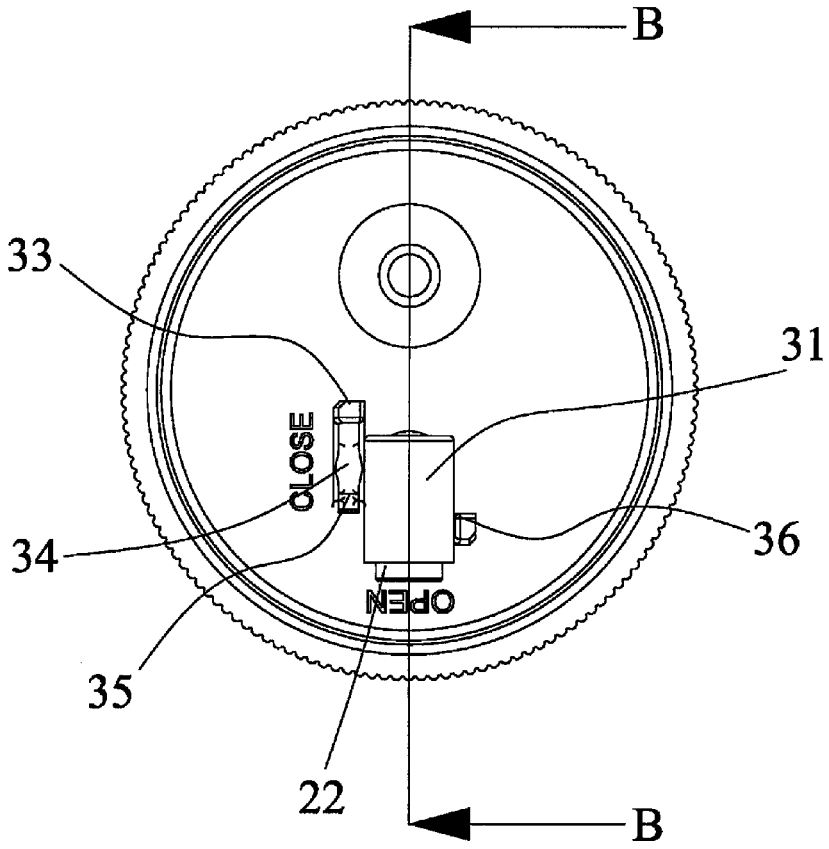
FIG. 2 is the structure drawing of the mineral water bottle cap of FIG. 1.
Figure 3:
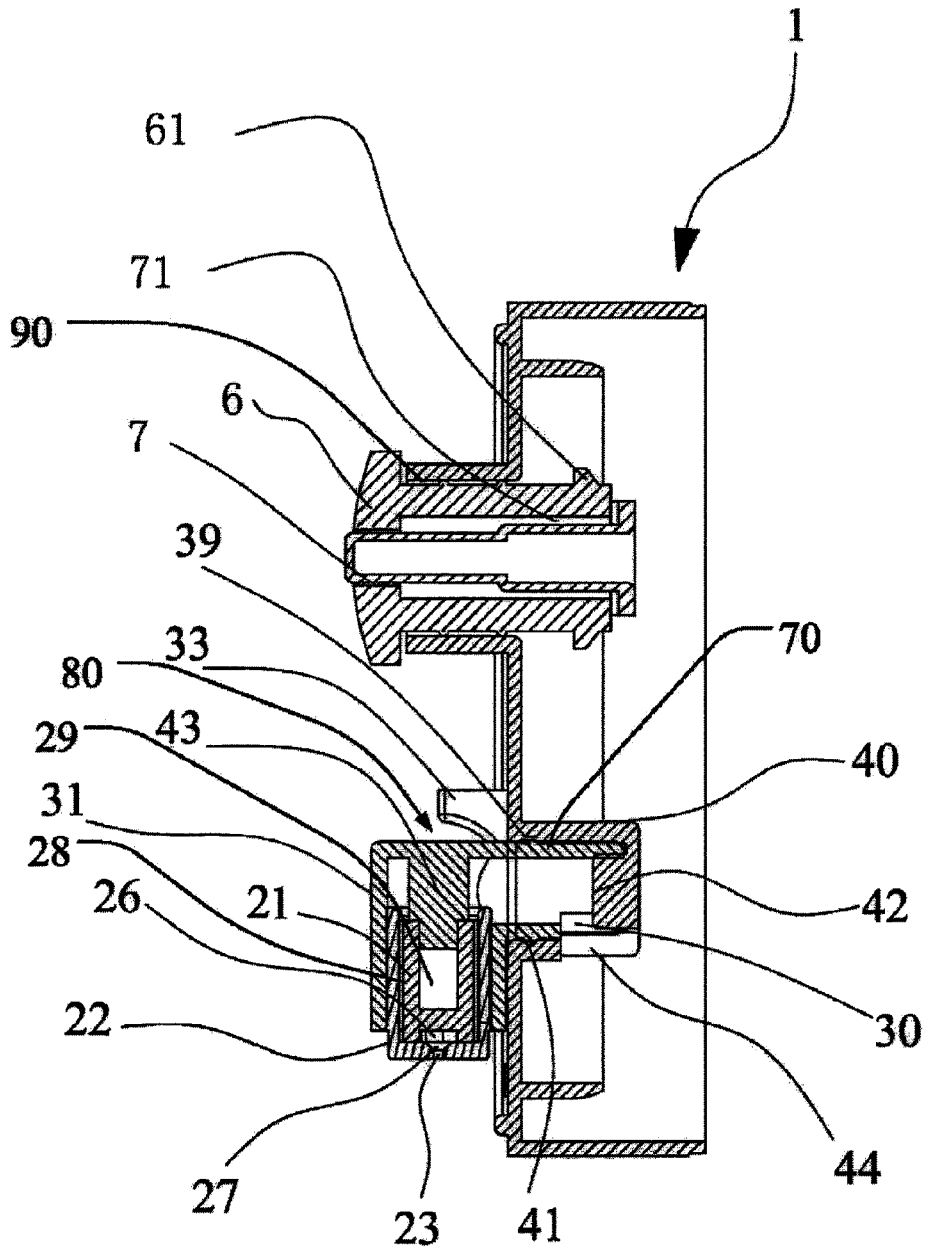
FIG. 3 is the B-B cutaway view of FIG. 2.

As shown from FIG. 1 to FIG. 3, A sport-type multifunctional spray mineral water bottle, including an elastic deformation bottle 5 and a spray mineral water bottle cap, wherein the spray mineral water bottle cap including cap body 1, spray means 2, drink means and water locking means. The cap body 1 and mineral water bottleneck are connected by means of liquid-tight fit, and an outlet is disposed on the end face of cap body 1. The cap body 1 is matched with mineral water bottleneck by means of liquid-tight fit, and an outlet aperture is disposed on the end face of cap body 1. The spray means 2 includes atomizing spool and nozzle 22, and at least two water channels are disposed on the outer wall of atomizing spool, and the number of water channels can be increased pursuant to the water volume; atomizing channel 26 corresponding to water channel is disposed on the end face of atomizing spool corresponding to the water channel, and water channel and atomizing channel 26 are connected by means of two connecting channels. Cavity is disposed in nozzle 22 to hold atomizing spool, and spray aperture 23 is disposed on the end face of one end of nozzle 22; atomizing spool is matched with the cavity of nozzle 22 by means of interference fit, and atomizing channel 26 is matched with nozzle 22 by means of coaxial round cavity 27.

The drink means includes a movable rubber plug 6 and the water outlet means 7, wherein when the movable rubber plug 6 moves up and down along the water outlet means 7, the plastic wall 61 in the movable rubber plug 6 connects and detach with the outlet in outlet means 7, so as to open or close the water outlet.

The water locking means, including a fixing part 40 and movable part rotating relative to fixing part 40, is a tube located axially in the center of cap body 1, and this tube bottom is closed and a cylindric protuberance 42 is disposed inside the bottom, and outlet 44 is disposed on the sidewall of the tube adjacent to the closing bottom. The movable part of water locking means is right angle shape, including two connected tubes, tube in vertical direction and tube 31 in horizontal direction, and tube and tube 31 are molded into one unit. The outer wall of tube is connected to the tube inner wall of fixing part 40 of water locking means by means of liquid-tight fit, and the port of tube is matched with cylindric protuberance 42. Inlet 30 is disposed at the bottom of tube corresponding to outlet 44, and the movable part rotates relative to fixing part 40 pursuant to tube as axis to fulfill butt joint or interleaving of outlet 44 and inlet 30, and thus to fulfill opening or closing of spray means 2. Cavity is disposed inside tube 31, and support bracket 43 supporting atomizing spool is disposed inside cavity, and spray means is disposed inside cavity and connected to cavity by means of interference and liquid-tight fit; support bracket 43 is used to support atomizing spool. In order to strengthen the liquid-tight effect between the vertical tube of movable part and tube of fixing part 40, an annular groove 41 is disposed on the inner wall of tube of fixing part 40 of water locking means, and an annular protuberance 39 is disposed on the movable part of the said water locking means, which is matched with groove 41 on the inner wall of tube of fixing part 40.

On-off position means of water locking means is disposed on the end face of cap body 1, and the position means includes position blocks 33 and 36 respectively fixed on 0° and 90° positions of end face of cap body 1, respectively positioning opening and closing of water locking means, and cambered surfaces 34 are disposed on the position blocks in the rotating direction of the tube in the vertical direction to match with the tube. A limiting protuberance 35 is disposed on the cambered surface bottom of the closed position block of the position water locking means corresponding to the other side of the tube in horizontal direction to prevent tube 31 from automatically opening without external force.

Embodiment 2

Figure 4:
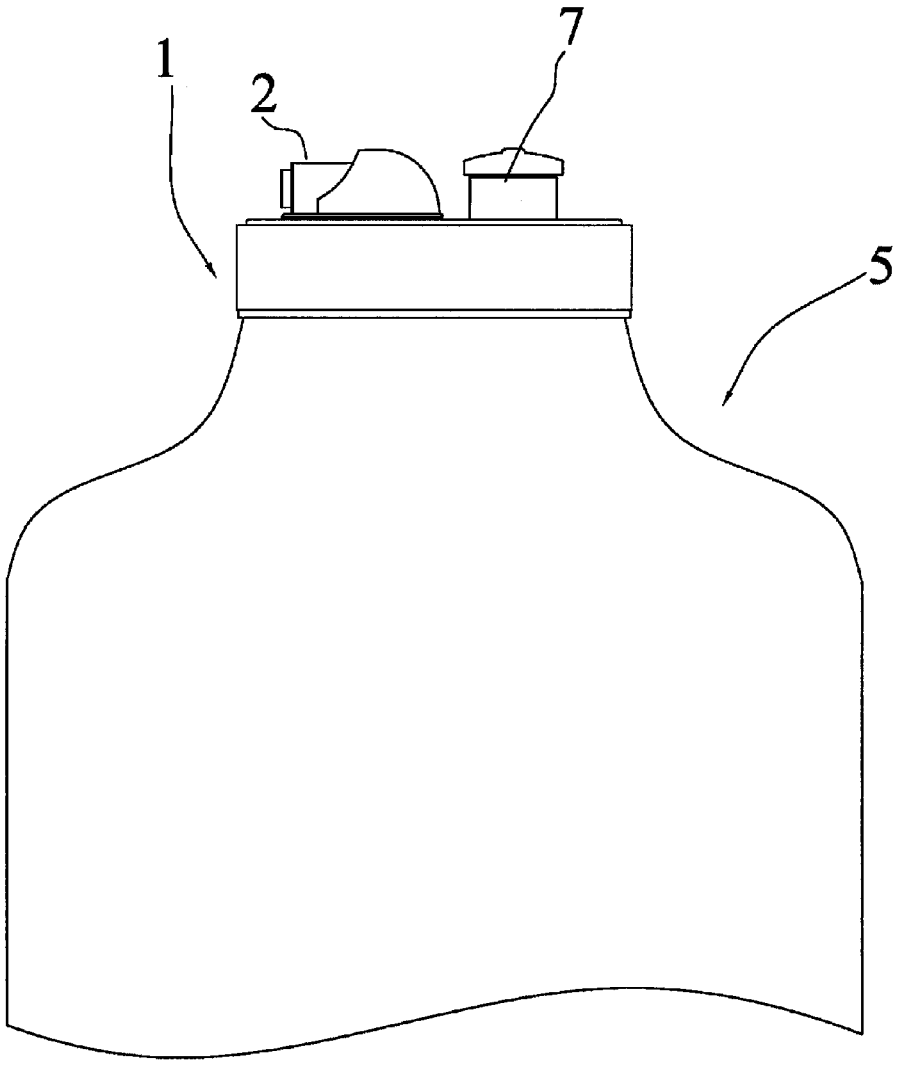
FIG. 4 is the structure drawing of the embodiment 2 of the invention.
Figure 5:
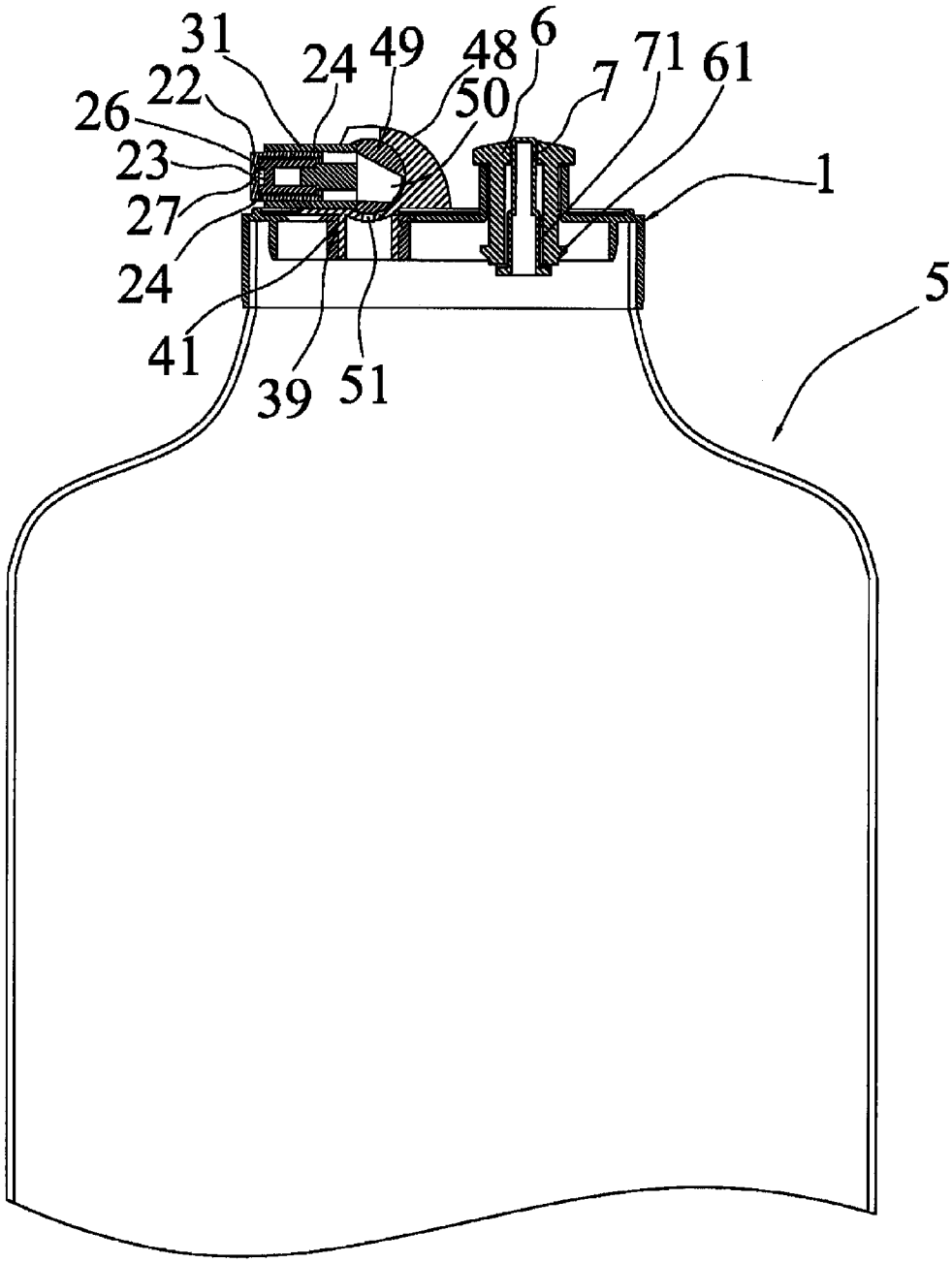
FIG. 5 is the cutaway view of the bottle cap of FIG. 4.

As shown from FIG. 4 to FIG. 5, A sport-type multifunctional spray mineral water bottle, including an elastic deformation bottle 5 and a spray mineral water bottle cap, wherein the spray mineral water bottle cap including cap body 1, spray means 2 and water locking means. The spray means 2 includes atomizing spool and nozzle 22, and at least two water channels 24 are disposed on the outer wall of atomizing spool, and the number of water channels can be increased pursuant to the water volume; atomizing channel 26 corresponding to water channel 24 is disposed on the end face of atomizing spool corresponding to the water channel 24, and water channel 24 and atomizing channel 26 are connected by means of two connecting channels. Cavity is disposed in nozzle 22 to hold atomizing spool, and spray aperture 23 is disposed on the end face of one end of nozzle 22; atomizing spool is matched with the cavity of nozzle 22 by means of interference fit, and atomizing channel 26 is matched with nozzle 22 by means of coaxial round cavity 27.

The drink means includes a movable rubber plug 6 and the water outlet means 7, wherein when the movable rubber plug 6 moves up and down along the water outlet means 7, the plastic wall 61 in the movable rubber plug 6 connects and detach with the outlet in outlet means 7, so as to open or close the water outlet.

The fixing part of water locking means is fixed on the end face of cap body 1, its bottom tube is sleeve jointed to the tube of cap body 1, and annular protuberance 39 is matched with annular groove 41. The spherical working face is disposed on the end face of bottom tube of the fixing part, and outlet 51 is disposed on the spherical working face; the said movable part of water locking means includes sphere 49 which is matched with spherical working face of fixing part by means of liquid-tight fit, and flexibly connected to the fixing part by means of the rotating axis; strip inlet 50 is disposed on the outlet 49 rotating track of the sphere, and when sphere 49 leaves the closing status of water locking means, the butt joint between outlet 51 and inlet 50 is opened; tube 31 is fixed on sphere 49, tube 31 cavity is connected to strip inlet 50, and open-end of the tube is connected to the spray means by means of interference and liquid-tight fit. Position means 48 for opening and closing the movable part is disposed on the fixing part, which allows the movable part to rotate within the specified radian of 90° degrees.

Embodiment 3

Figure 6:
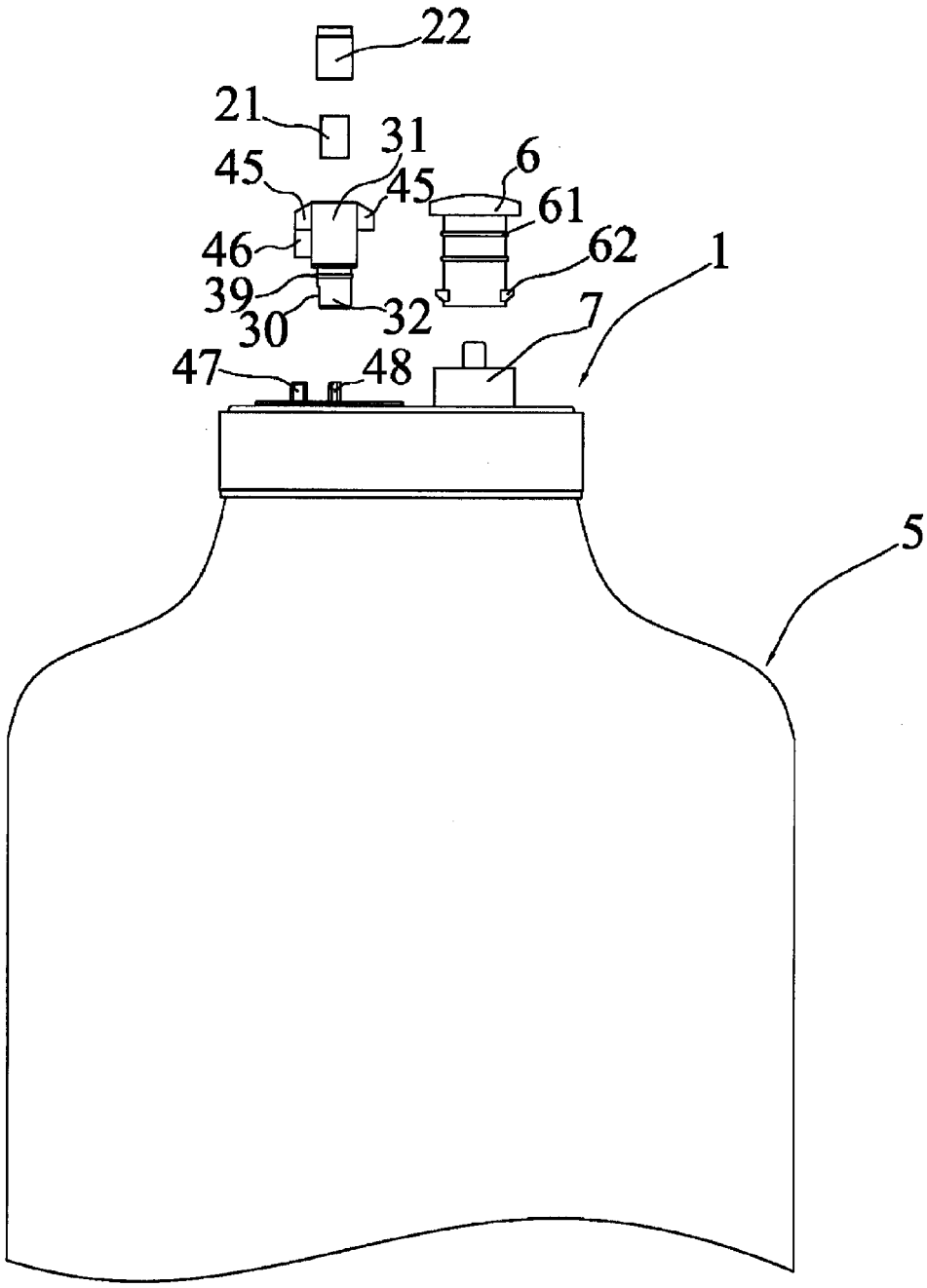
FIG. 6 is the structure drawing of the embodiment 3 of the invention.

As shown in FIG. 6, A sport-type multifunctional spray mineral water bottle, including an elastic deformation bottle 5 and a spray mineral water bottle cap, wherein the spray mineral water bottle cap has ready described clearly in embodiment 1, hereinafter is not be repeated here. In comparison with the right angle shaped movable part of water locking means in the embodiment 1, the movable part of water locking means in embodiment 2 is straight line shape, including movable part tube 31 and tube 32, wherein tube 32 is sleeve jointed inside the fixing part tube in the embodiment 1, annular protuberance 39 is matched with annular groove, the bottom port of tube 32 is matched with cylindric protuberance at the bottom of the fixing part tube, the movable part rotates relative to the fixing part back and forth to fulfill the butt joint or interleaving between inlet 30 and outlet, thus achieving the opening and closing of the spray means. A cavity is disposed inside tube 31, atomizing spool 21 is sleeve jointed to the cavity of the nozzle to form spray means 2, and the spray means is sleeve jointed to the cavity of tube 31. To facilitate rotation of the movable part of water locking means, rotating handles 45 are disposed at both sides of upper end of tube 31. On-off position means is disposed between the middle of tube 31 and end face of cap body 1, and this position means includes position blocks 47 and 48 respectively fixed on 0° and 90° positions of end face of cap body and limiting stopper 46 fixed on the corresponding position of the movable part.

The drink means includes a movable rubber plug 6 and the water outlet means 7, wherein when the movable rubber plug 6 moves up and down along the water outlet means 7, the plastic wall 61 in the movable rubber plug 6 connects and detach with the outlet in outlet means 7, so as to open or close the water outlet.

With the coordination of the elastic mineral water boty and the capy, the spray mineral water of the invention can ensure normal drinking of mineral water as well as carry out spray drinking of water by means of squeezing the bottle body to transform bottle body and increase the pressure inside, thus making water to enter inlet from the outlet of water locking means on the cap, and to enter the atomizing channel through the water channel, finally to be sprayed from the spray aperture. Furthermore, in the open air or in the dusty and hot environment, you can place the mineral water bottle upside down, put the nozzle to face your body or surrounding, and squeeze the bottle body to spray, thus reducing surrounding temperature, as well as subsiding dust by combining dust and spray to make you feel cool, fresh and comfortable. This invention features in simple structure and strong practicability, so it has promising market prospect.

The foregoing descriptions of the embodiments and their accompanying drawings of the invention are intended to illustrate and not to limit this invention. Various changes and modifications may be made to the embodiments without departing from the spirit of the invention. Therefore, the scope of the invention is to be limited only by the appended claims.

What is claimed is:

1. A mineral water bottle, comprising an elastic deformation bottle and a spray mineral water bottle cap, characterized in that the spray mineral water bottle cap comprises:

a cap body secured on a bottleneck of the mineral water bottle and covering an open of the mineral water bottle, wherein the cap body defines an outlet aperture on an end face of the cap body;

a drink means comprising a movable rubber plug, and wherein the cap body defines a water outlet, and the movable rubber plug moves along the water outlet to open or close the water outlet;

a spray means comprising an atomizing spool and a nozzle, wherein at least two water channels are defined on the outer wall of the atomizing spool, and atomizing channels are defined on an end face of the water channels, and correspond to the water channels; and wherein the nozzle defines a cavity to receive the atomizing spool, and a spray aperture is defined on an end face of the nozzle; and wherein the atomizing spool matches with the cavity of the nozzle by interference fit, and the atomizing aperture communicates with the nozzle; and a water locking means comprising a fixing part and a movable part rotating relative to the fixing part, and wherein the fixing part is fixed with the cap body and defines a first outlet; and wherein the movable part defines a first inlet corresponding to the first outlet of fixing part; and wherein the movable part rotates relative to the fixing part back and forth to result the first outlet of the fixing part to align the first inlet of the movable part or interleaving between the first outlet of the fixing part and the first inlet of the movable part, thus achieving the opening or closing of the spray means; and the movable part defines a receiving space securing the spray means by way of interference fit; and wherein the fixing part of the water locking means comprises a cylindrical protuberance located on an interior of a bottom of the fixing part, and wherein the cylindrical protuberance engages with the bottom of the movable part of the water locking means;

wherein the elastic deformation bottle is squeezed to increase the pressure inside the elastic deformation bottle, water inside the elastic deformation bottle enters the first inlet of the movable part from the first outlet of the fixing part, and then enters the atomizing channels through the water channels, finally sprays out from the spray aperture.

2. The mineral water bottle of claim 1, wherein the fixing part of the water locking means comprises a tube located axially in the center of the cap body, and a bottom of the tube is sealed, the first outlet is defined on a sidewall of the tube adjacent to the bottom of the tube; a bottom of the movable part is sleeved in the tube, and wherein the movable part rotates relative to the tube, the first inlet of the movable part is located on the bottom of the movable part, and corresponds to the first outlet of the tube; and wherein when the movable part rotates relative to the fixing part to result the first outlet to communicate with the first inlet, the spray means is opened, and when the first outlet is staggered with the first inlet, the spray means is closed.

3. The mineral water bottle of claim 2, wherein the tube defines an annular groove on an inner wall of the tube, and the movable part comprises an annular protuberance engaging with the annular groove on the inner wall of the tube of the fixing part.

4. The mineral water bottle of claim 2, wherein the movable part of the water locking means is in a shape of a right angle, and comprises a first connecting tube in a vertical direction, and a second connecting tube in a horizontal direction, and the first connecting tube is integrated with the second connecting tube; and wherein the first connection tube is connected to the fixing part of the water locking means by means of liquid-tight fit, the movable part rotates relative to the fixing part around an axis of the first connecting tube; and wherein the receiving space is located on the second connecting tube, and the spray means is secured in the receiving space by means of interference and liquid-tight fit.

5. The mineral water bottle of claim 4, wherein an on-off position means is located on an end surface of the cap body, and the on-off position means comprises a pair of position blocks respectively fixing the spray means on 0° and 90° positions, the pair of positioning blocks are configured to fix the water locking means in an open position and in a close position, respectively, and wherein each positioning block comprises a cambered surface matched with the second connecting tube.

6. The mineral water bottle of claim 5, wherein a limiting protuberance is disposed on one side of a bottom of the cambered surface of one of the positioning blocks, and the one of the positioning blocks corresponds to the close position of the water locking means, and the limiting protuberance fixes the water locking means in the close position.

7. The mineral bottle of claim 4, wherein a supporting bracket projects from an interior surface of the second connecting tube, and extends into the cavity of the nozzle to support the atomizing spool.

8. The mineral bottle of claim 1, wherein the drink means further comprises a water outlet means fixed with the cap body, a gap is formed between the water outlet means and the movable rubber plug, and the movable rubber plug comprises a plastic wall, and wherein when the movable rubber plug moves up along the water outlet means, the plastic wall of the movable rubber plug connects with the water outlet, and the water inside the elastic deformation bottle pours out along the gap.

9. A mineral water bottle, comprising an elastic deformation bottle and a spray mineral water bottle cap, characterized in that the spray mineral water bottle cap comprises:

a cap body secured on a bottleneck of the mineral water bottle and covering an open of the mineral water bottle, wherein the cap body defines an outlet aperture on an end face of the cap body;

a drink means comprising a movable rubber plug, and wherein the cap body defines a water outlet, and the movable rubber plug moves along the water outlet to open or close the water outlet;

a spray means comprising an atomizing spool and a nozzle, wherein at least two water channels are defined on the outer wall of the atomizing spool, and atomizing channels are defined on an end face of the water channels, and correspond to the water channels; and wherein the nozzle defines a cavity to receive the atomizing spool, and a spray aperture is defined on an end face of the nozzle; and wherein the atomizing, spool matches with the cavity of the nozzle by interference fit, and the atomizing aperture communicates with the nozzle; and a water locking means comprising a fixing past and a movable part rotating relative to the fixing part, and wherein the fixing part is fixed with the cap body and defines a first outlet; and wherein the movable part defines a first inlet corresponding to the first outlet of fixing part; and wherein the movable part rotates relative: to the fixing part back and forth to result the first outlet of the fixing part to align the first inlet of the movable part or interleaving between the first outlet of the fixing part and the first inlet of the movable part, thus achieving the opening or closing of the spray means; and the movable part defines a receiving space securing the spray means by way of interference fit;

wherein the elastic deformation bottle is squeezed to increase the pressure inside the elastic deformation bottle, water inside the elastic deformation bottle enters the first inlet of the movable part from the first outlet of the fixing part, and then enters the atomizing channels through the water channels, finally sprays out from the spray aperture;

wherein the fixing part of the water locking means comprises a tube located axially in the center of the cap body, and a bottom of the tube is sealed, the first outlet is defined on a sidewall of the tube adjacent to the bottom of the tube; a bottom of the movable part is sleeved in the tube, and wherein the movable part rotates relative to the tube, the first inlet of the movable part is located on the bottom of the movable part, and corresponds to the first outlet of the tube; and wherein when the movable part rotates relative to the fixing part to result the first outlet to communicate with the first inlet, the spray means is opened, and when the first outlet is staggered with the first inlet, the spray means is closed;

wherein the movable part of the water locking means is in a shape of a right angle, and comprises a first connecting tube in a vertical direction, and a second connecting tube in a horizontal direction, and the first connecting tube is integrated with the second connecting tube; and wherein the first connection tube is connected to the fixing part of the water locking means by means of liquid-tight fit, the movable part rotates relative to the fixing part around an axis of the first connecting tube; and wherein the receiving space is located on the second connecting tube, and the spray means is secured in the receiving space by means of interference and liquid-tight fit;

wherein an on-off position means is located on an end surface of the cap body, and the on-off position means comprises a pair of position blocks respectively fixing the spray means on 0° and 90° positions, the pair of positioning blocks are configured to fix the water locking means in an open position and in a close position, respectively, and wherein each positioning block comprises a cambered surface matched with the second connecting tube; and wherein a limiting protuberance is disposed on one side of a bottom of the cambered surface of one of the positioning blocks, and the one of the positioning blocks corresponds to the close position of the water locking means, and the limiting protuberance fixes the water locking means in the close position.

* * * * *